US011514883B2

(12) United States Patent
Fang et al.

(10) Patent No.: US 11,514,883 B2
(45) Date of Patent: Nov. 29, 2022

(54) ACTIVE NOISE REDUCTION SYSTEM AND METHOD, AND STORAGE MEDIUM

(71) Applicant: RDA MICROELECTRONICS (SHANGHAI) CO., LTD., Shanghai (CN)

(72) Inventors: Simin Fang, Shanghai (CN); Jiayi Zhuang, Shanghai (CN); Kai Li, Shanghai (CN)

(73) Assignee: RDA MICROELECTRONICS (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/639,399

(22) PCT Filed: Aug. 2, 2019

(86) PCT No.: PCT/CN2019/098958

§ 371 (c)(1),
(2) Date: Feb. 14, 2020

(87) PCT Pub. No.: WO2021/022390

PCT Pub. Date: Feb. 11, 2021

(65) Prior Publication Data

US 2022/0157288 A1 May 19, 2022

(51) Int. Cl.
*G10K 11/178* (2006.01)
*G10L 21/02* (2013.01)

(52) U.S. Cl.
CPC .. *G10K 11/17853* (2018.01); *G10K 11/17855* (2018.01); *G10K 11/17873* (2018.01); *G10L 21/02* (2013.01)

(58) Field of Classification Search
CPC ..... G10K 11/17853; G10K 11/17855; G10K 11/17873; G10L 21/02
(Continued)

(56) References Cited

U.S. PATENT DOCUMENTS

2003/0072464 A1 4/2003 Kates
2006/0293016 A1 12/2006 Giesbrecht
(Continued)

FOREIGN PATENT DOCUMENTS

CN 1640190 A 7/2005
CN 1893412 A 1/2007
(Continued)

OTHER PUBLICATIONS

Patent Cooperation Treaty: International Search Report and Written Opinion for PCT/CN2019/098958 dated May 9, 2020; 13 pages including English translation.

*Primary Examiner* — Paul Kim
*Assistant Examiner* — Douglas J Suthers
(74) *Attorney, Agent, or Firm* — Schwabe, Williamson & Wyatt, PC

(57) ABSTRACT

An active noise reduction system and method, and a storage medium are provided. In the system, a first signal acquisition circuitry acquires an external noise signal at a noise cancellation spot, and transmits the acquired external noise signal to a noise control system including a first frequency nonlinear transformation circuitry, a first filter circuitry and an inverter. The first frequency nonlinear transformation circuitry receives the external noise signal, and expands at least one target frequency band of the external noise signal based on a frequency nonlinear transformation mapping function to generate a first transformed external noise signal, the first filter circuitry filters the first transformed external noise signal to generate a filtered external noise signal, and the inverter performs inversion on the filtered external noise signal to generate a noise cancellation signal; and the signal output circuitry receives and outputs the noise cancellation signal to cancel an actual noise.

21 Claims, 6 Drawing Sheets

(58) Field of Classification Search
USPC ..... 381/71.6
See application file for complete search history.

(56) References Cited

U.S. PATENT DOCUMENTS

| | | | | |
|---|---|---|---|---|
| 2007/0055505 | A1 | 3/2007 | Doclo | |
| 2010/0272283 | A1 | 10/2010 | Carreras | |
| 2011/0007907 | A1* | 1/2011 | Park | G10K 11/17855 381/71.8 |
| 2011/0249843 | A1* | 10/2011 | Holmberg | H04R 25/353 381/98 |
| 2018/0182410 | A1 | 6/2018 | Kaskari | |

FOREIGN PATENT DOCUMENTS

| | | | |
|---|---|---|---|
| CN | 103714825 | A | 4/2014 |
| CN | 105825846 | A | 8/2016 |
| CN | 107864419 | A | 3/2018 |
| CN | 109599123 | A | 4/2019 |

* cited by examiner

ACTIVE NOISE REDUCTION SYSTEM AND METHOD, AND STORAGE MEDIUM

CROSS-REFERENCE TO RELATED APPLICATION

The present application is a national phase entry under 35 U.S.C. § 371 of International Application No. PCT/CN2019/098958, filed Aug. 2, 2019, which designates the United States of America, the entire disclosure of which is hereby incorporated by reference in its entirety and for all purposes.

TECHNICAL FIELD

The present disclosure generally relates to a signal processing technology field, and more particularly, to an active noise reduction system and method, and a storage medium.

BACKGROUND

Active noise reduction technology is widely applied in our lives to reduce noise interference and create more comfortable listening environment.

Noises in actual environment are often variable and complex. Different noises have different spectral characteristics, where some have more concentrated spectrums, and some have wider spectrums. If differences in noise spectral characteristics are not considered, noise reduction performance of systems will be limited, resulting in an undesired noise reduction effect.

Weight filters have been introduced for solving the above problem. However, if the filters are simple in design, it is quite difficult to meet requirements of multi-target bands. On the contrary, for flexible settings, complexity of the filters is increased, which requires more resources.

Therefore, a new active noise reduction system and method are needed, so as to achieve a better noise reduction effect with a lower resource cost.

SUMMARY

Embodiments of the present disclosure may achieve a better noise reduction effect with a lower resource cost.

In an embodiment of the present disclosure, an active noise reduction system is provided, including a first signal acquisition circuitry, a noise control system and a signal output circuitry, wherein the first signal acquisition circuitry and the signal output circuitry are coupled with the noise control system, wherein the first signal acquisition circuitry is configured to acquire an external noise signal at a noise cancellation spot, and transmit the acquired external noise signal to the noise control system; the noise control system includes a noise cancellation signal generation circuitry, the noise cancellation signal generation circuitry includes a first frequency nonlinear transformation circuitry, a first filter circuitry and an inverter, wherein the first frequency nonlinear transformation circuitry is configured to receive the external noise signal, and expand at least one target frequency band of the external noise signal based on a frequency nonlinear transformation mapping function to generate a first transformed external noise signal, the first filter circuitry is configured to filter the first transformed external noise signal to generate a filtered external noise signal, and the inverter is configured to perform inversion on the filtered external noise signal to generate a noise cancellation signal; and the signal output circuitry is configured to receive and output the noise cancellation signal to cancel an actual noise.

Optionally, the at least one target frequency band includes a plurality of target frequency bands corresponding to different expansion ratios.

Optionally, the first frequency nonlinear transformation circuitry is further configured to compress at least one other frequency band other than the at least one target frequency band of the external noise signal.

Optionally, the at least one other frequency band includes a plurality of frequency bands corresponding to different compression ratios.

Optionally, the active noise reduction system further includes a second signal acquisition circuitry, and the noise control system further includes a coefficient update circuitry, wherein the second signal acquisition circuitry is configured to acquire a residual noise signal and transmit the acquired residual noise signal to the coefficient update circuitry, and the coefficient update circuitry is configured to update a coefficient of the first filter circuitry based on the residual noise signal in real time.

Optionally, the coefficient update circuitry includes a second frequency nonlinear transformation circuitry and a coefficient calculation circuitry, wherein the second frequency nonlinear transformation circuitry is configured to expand the at least one target frequency band of the external noise signal to generate a second transformed external noise signal, and the coefficient calculation circuitry is configured to calculate the coefficient of the first filter circuitry based on the residual noise signal and the second transformed external noise signal.

Optionally, the noise cancellation signal generation circuitry further includes a first downsampling rate circuitry and an upsampling rate circuitry, and the coefficient update circuitry includes a second downsampling rate circuitry, wherein the first downsampling rate circuitry is configured to downsample the external noise signal to an operation sampling rate of the first frequency nonlinear transformation circuitry, the upsampling rate circuitry is configured to upsample the noise cancellation signal to an operation sampling rate of the signal output circuitry, and the second downsampling rate circuitry is configured to downsample the external noise signal to an operation sampling rate of the second frequency nonlinear transformation circuitry.

Optionally, the noise control system is a feedforward plus feedback hybrid system, the active noise reduction system further includes a second signal acquisition circuitry, and the noise control system further includes a third frequency nonlinear transformation circuitry, a second filter circuitry and a mixing circuitry, wherein the second signal acquisition circuitry is configured to acquire a residual noise signal, the third frequency nonlinear transformation circuitry is configured to receive the residual noise signal and expand at least one target frequency band of the residual noise signal to generate a transformed residual noise signal, the second filter circuitry is configured to filter the transformed residual noise signal to generate a filtered residual noise signal, and the mixing circuitry is configured to combine the filtered external noise signal with the filtered residual noise signal to generate a combined noise signal, and the inverter is configured to perform inversion on the combined noise signal to generate the noise cancellation signal.

In an embodiment of the present disclosure, an active noise reduction method is provided, including: acquiring an external noise signal at a noise cancellation spot; expanding at least one target frequency band of the external noise signal based on a frequency nonlinear transformation mapping function to generate a transformed external noise signal; filtering the transformed external noise signal to generate a filtered external noise signal; performing inversion on the filtered external noise signal to generate a noise cancellation signal; and outputting the noise cancellation signal to cancel an actual noise.

Optionally, the at least one target frequency band includes a plurality of target frequency bands corresponding to different expansion ratios.

Optionally, prior to the filtering, the method further includes: compressing at least one other frequency band other than the at least one target frequency band of the external noise signal.

Optionally, the at least one other frequency band includes a plurality of frequency bands corresponding to different compression ratios.

Optionally, the method further includes: acquiring a residual noise signal; and updating a coefficient of a filter circuitry which filters the transformed external noise signal based on the residual noise signal in real time.

Optionally, the coefficient of the filter circuitry is calculated based on the residual noise signal and the transformed external noise signal.

Optionally, the method employs a feedforward plus feedback hybrid mode, and further includes: acquiring a residual noise signal; expanding at least one target frequency band of the residual noise signal to generate a transformed residual noise signal; filtering the transformed residual noise signal to generate a filtered residual noise signal; combining the filtered external noise signal with the filtered residual noise signal to generate a combined noise signal; and performing inversion on the combined noise signal to generate the noise cancellation signal.

In an embodiment of the present disclosure, a storage medium having computer instructions stored therein is provided, wherein once the computer instructions are executed, the above active noise reduction method is performed.

Embodiments of the present disclosure may provide following advantages.

In embodiments of the present disclosure, the first signal acquisition circuitry acquires an external noise signal at a noise cancellation spot. The first frequency nonlinear transformation circuitry receives the external noise signal, and expands at least one target frequency band of the external noise signal to generate a first transformed external noise signal. The first filter circuitry filters the first transformed external noise signal to generate a filtered external noise signal. The inverter performs inversion on the filtered external noise signal to generate a noise cancellation signal. The signal output circuitry receives and outputs the noise cancellation signal to cancel an actual noise. In the embodiments, the frequency nonlinear transformation mapping function is used to expand the at least one target frequency band of the external noise signal to nonlinearize frequencies of the external noise signal, so that a weight of the target frequency band is increased and the noise reduction leans to the target frequency band, which leads to a better noise reduction effect with fewer resources.

Further, a plurality of target frequency bands may be expanded according to practical requirements during the frequency nonlinear transformation, and the plurality of target frequency bands may correspond to different expansion ratios to achieve better performance.

Further, the first frequency nonlinear transformation circuitry is further configured to compress at least one other frequency band which is not important acoustically, so that the noise reduction further leans to the target frequency band. The at least one other frequency band may include a plurality of frequency bands corresponding to different compression ratios to achieve better performance.

Further, the noise control system supports a fixed coefficient mode and an online real-time updated coefficient mode. Under the online real-time updated coefficient mode, the coefficient of the first filter circuitry is updated based on the residual noise signal in real time, so that the generated noise cancellation signal may be more approximate to the external noise signal, which further improves noise reduction performance.

DETAILED DESCRIPTION

As described in background, noises in actual environment are often variable and complex. Different noises have different spectral characteristics. If differences in noise spectral characteristics are not considered, noise reduction performance of systems will be limited, resulting in an undesired noise reduction effect. Weight filters have been introduced for solving the above problem. However, if the filters are simple in design, it is quite difficult to meet requirements of multi-target bands. On the contrary, for flexible settings, complexity of the filters is increased, which requires more resources.

In embodiments of the present disclosure, a first signal acquisition circuitry acquires an external noise signal at a noise cancellation spot. A first frequency nonlinear transformation circuitry receives the external noise signal, and expands at least one target frequency band of the external noise signal to generate a first transformed external noise signal. A first filter circuitry filters the first transformed external noise signal to generate a filtered external noise signal. An inverter performs inversion on the filtered external noise signal to generate a noise cancellation signal. A signal output circuitry receives and outputs the noise cancellation signal to cancel an actual noise. In the embodiments, a frequency nonlinear transformation mapping function is used to expand the at least one target frequency band of the external noise signal to nonlinearize frequencies of the external noise signal, so that a weight of the target frequency band is increased and the noise reduction leans to the target frequency band, which leads to a better noise reduction effect with fewer resources.

In order to clarify the object, characteristic and advantages of embodiments of the present disclosure, embodiments of present disclosure will be described clearly in detail in conjunction with accompanying drawings.

Figure 1:
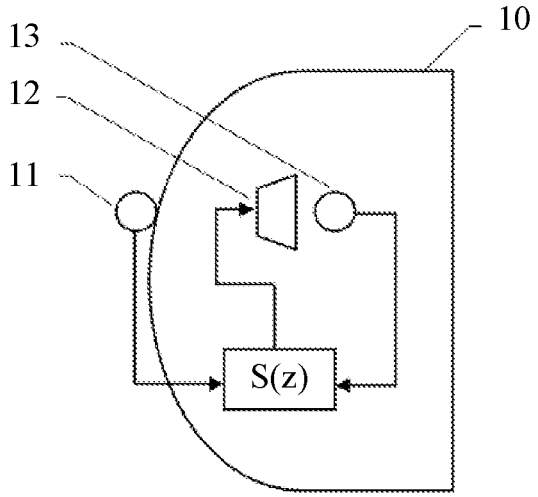
FIG. 1 is a diagram illustrating principle of active noise reduction according to an embodiment.

FIG. 1 is a diagram illustrating principle of active noise reduction according to an embodiment. Referring to FIG. 1, a noise cancellation spot 10 may be an earphone, a factory, a car, a train or an airplane. Take the noise cancellation spot 10 being an earphone as an example. When a user wears the earphone, a relatively closed space is formed inside the earphone, and the earphone shell can effectively block a part of high-frequency noises from entering the earphone (referred to as passive noise reduction of the earphone). However, the earphone shell has weak suppression on low-frequency noises, and a large amount of low-frequency noises still enter the earphone shell and are received by an ear. A noise in external environment is acquired by a first sound acquisition circuitry 11 (such as a microphone) located outside the noise cancellation spot, and then an noise cancellation signal is generated through an S(z) system. The noise cancellation signal passes through a sound output circuitry 12 located inside the noise cancellation spot (such as a speaker) and is superposed, in a space inside the earphone, on the noise entering the earphone which has been subjected to the passive noise reduction to realize noise cancellation, thereby achieving active noise reduction. Further, the residual noise is acquired back to the S(z) system by a second sound acquisition circuitry 13 (such as a microphone) located inside the noise cancellation spot for updating a filter in the S(z) system, so as to further improve noise reduction performance.

Figure 2:
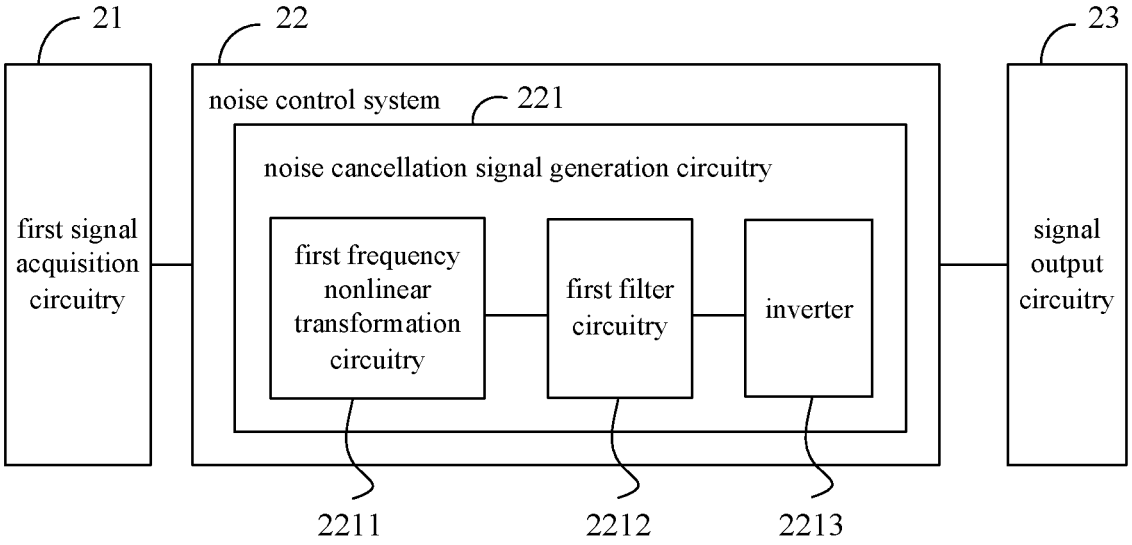
FIG. 2 is a block diagram of an active noise reduction system according to an embodiment.

FIG. 2 is a block diagram of an active noise reduction system according to an embodiment. Referring to FIG. 2, the active noise reduction system includes a first signal acquisition circuitry 21, a noise control system 22 and a signal output circuitry 23, wherein the first signal acquisition circuitry 21 and the signal output circuitry 23 are coupled with the noise control system 22.

Still referring to FIG. 2, the first signal acquisition circuitry 21 is located outside a noise cancellation spot, and configured to acquire an external noise signal at the noise cancellation spot, and transmit the acquired external noise signal to the noise control system 22. In some embodiments, the first signal acquisition circuitry 21 includes a microphone and an analog to digital converter. The microphone converts the acquired external noise signal into an analog electric signal, and the analog to digital converter converts the analog electric signal into a digital signal.

In some embodiments, the noise control system 22 is located inside the noise cancellation spot, and includes a noise cancellation signal generation circuitry 221. The noise cancellation signal generation circuitry 221 includes a first frequency nonlinear transformation circuitry 2211, a first filter circuitry 2212 and an inverter 2213, wherein the first frequency nonlinear transformation circuitry 2211 is configured to receive the external noise signal, and expand at least one target frequency band of the external noise signal based on a frequency nonlinear transformation mapping function to generate a first transformed external noise signal. The first filter circuitry 2212 is configured to filter the first transformed external noise signal to generate a filtered external noise signal. The inverter 2213 is configured to perform inversion on the filtered external noise signal to generate a noise cancellation signal. The noise cancellation signal is played in a space of the noise cancellation spot, and interferes with a noise in the space of the noise cancellation spot from external environment, to achieve active noise reduction.

The signal output circuitry 23 is located inside the noise cancellation spot and configured to receive and output the noise cancellation signal to cancel an actual noise. In some embodiments, the signal output circuitry 23 includes a speaker and a digital to analog converter. The digital to analog converter converts an inverted digital signal obtained by the inverter 2213 into an analog electric signal, and the speaker converts the analog electric signal into a sound signal, i.e., the noise cancellation signal.

In some embodiments, the noise control system 22 may employ an Application Specific Integrated Circuit (ASIC), a Digital Signal Processor (DSP), a Field Programmable Gate Array (FPGA), a Central Processing Unit (CPU) or a Microcontroller Unit (MCU).

Signal processing in the active noise reduction system provided in the embodiments of the present disclosure is described in detail in conjunction with FIG. 3 below.

Figure 3:
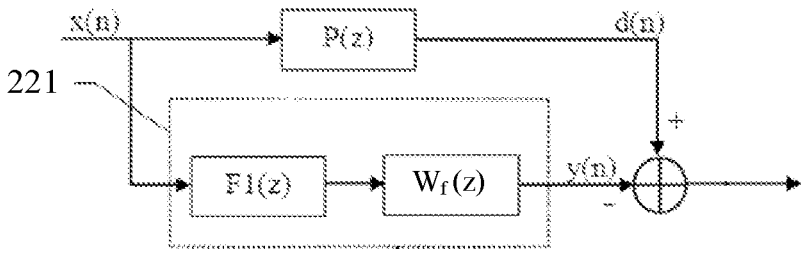
FIG. 3 is a structural diagram of the active noise reduction system as shown in FIG. 2.

As shown in FIG. 3, x(n) is the external noise signal acquired by the first signal acquisition circuitry 21, P(z) represents a transfer function applied on the external noise signal by a earphone shell, and d(n) is the external noise signal after passing through the earphone shell. F1(z) represents a frequency nonlinear transformation mapping function employed by the frequency nonlinear transformation circuitry 2211, and $W_f(z)$ represents a filter function employed by the first filter circuitry 2212. The external noise signal y(n) subjected to the frequency nonlinear transformation and the filtering is inverted to form the noise cancellation signal which is played by the signal output circuitry 23 and then interferes with the external noise signal d(n) entering the earphone shell, thereby achieving active noise reduction.

Frequencies of the external noise signal x(n) are linear and uniform, while energy at frequencies is generally not uniform. To improve noise reduction performance, it is desired to increase a weight of noise reduction for a frequency band that has a large impact on hearing (i.e., the target frequency band). Therefore, in the embodiments of the present disclosure, the frequency nonlinear transformation mapping function F(z) is provided, where uniform and linear frequencies are mapped to nonlinear frequencies.

In some embodiments, the first frequency nonlinear transformation circuitry 2211 may further compress acoustically unimportant frequency bands while expanding the at least one target frequency band, so that the noise reduction further leans to the target frequency band. A purpose of the frequency nonlinear transformation mapping function is to expand the at least one target frequency band and compress at least one other frequency band. The target frequency band is an acoustically important frequency band which has relatively large influence on hearing, and the other frequency band is an acoustically unimportant frequency band. In some embodiments, the target frequency band has higher noise energy.

In some embodiments, a plurality of target frequency bands may be expanded according to practical requirements during frequency nonlinear transformation, and assigned with different expansion ratios to achieve better performance. In some embodiments, the at least one other frequency band includes a plurality of frequency bands corresponding to different compression ratios to achieve better performance. The frequency nonlinear transformation mapping function F(z) may be flexibly designed according to different noise cancellation spots.

In some embodiments, F(z) may be implemented with, but not limited to, an all-pass filter, which ensures that a signal passing through F(z) remains its amplitude constant and has its phase nonlinearly changed, thereby achieving nonlinear transformation of the frequency.

Figure 4:
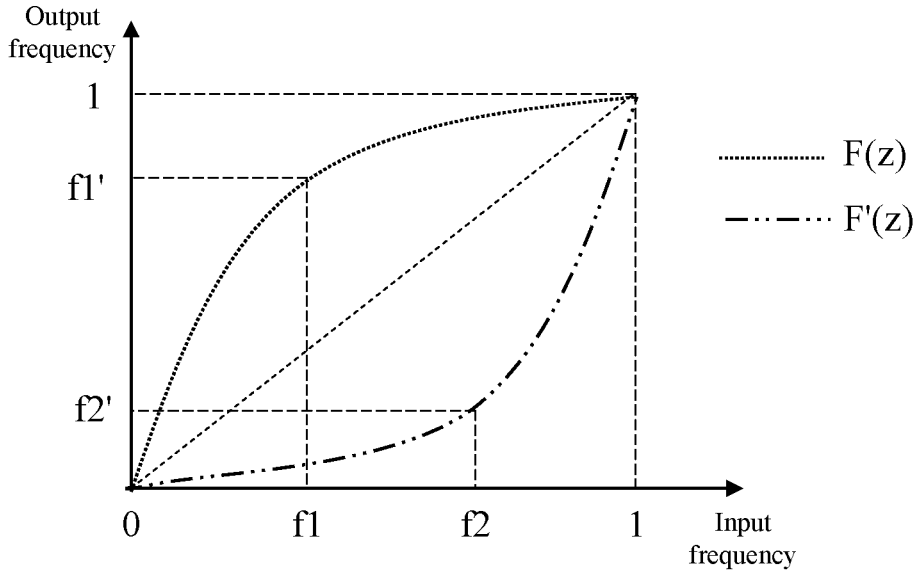
FIGS. 4 and 5 are diagrams of frequency nonlinear transformation according to an embodiment.
Figure 5:
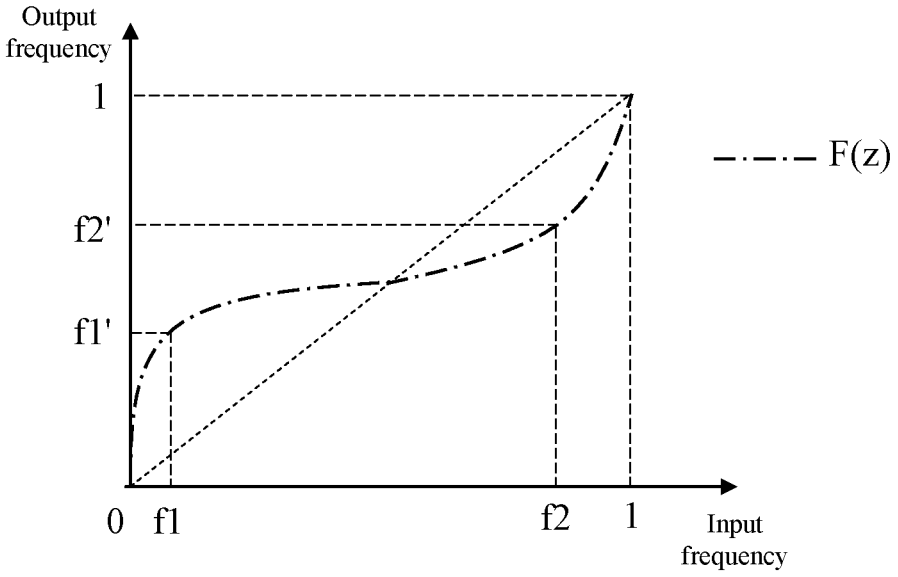

FIGS. 4 and 5 are diagrams of frequency nonlinear transformation according to an embodiment. In FIGS. 4 and 5, frequencies of the signal are normalized prior to the frequency nonlinear transformation, thus, frequencies of the signal before the transformation are expressed as (0, 1).

First, referring to FIG. 4, FIG. 4 illustrates two different frequency nonlinear transformation mapping functions F(z) and F'(z). The frequency nonlinear transformation mapping function F(z) expands a frequency band of 0~f1 to 0~f1', and compresses a frequency band of f1~1 to f1'~1. The frequency nonlinear transformation mapping function F'(z) compresses a frequency band of 0~f2 to 0~f2', and expands a frequency band of f2~1 to f2'~1. Compared with the frequency bands of 0~f1 and f2~1, the frequency bands of 0~f1' and f2'~1 have higher weights in a nonlinear transformation domain, and will be emphatically suppressed in subsequent filtering.

As described above, in some embodiments, different expansion ratios may be set for different target frequency bands to achieve different noise reduction depth. For example, the frequency nonlinear transformation mapping function F(z) shown in FIG. 5 achieves separate expansion of the two target frequency bands. F(z) in FIG. 5 realizes the expansion of the two frequency bands of 0~f1 and f2~1 and the compression of the frequency band of f1~f2, where the expansion ratio of the frequency band of 0~f1 is higher than that of the frequency band of f2~1, that is, the frequency band of 0~f1 has a higher weight.

In some embodiments, a range of the target frequency band in the frequency nonlinear transformation is set between 50 Hz to 2 kHz, which depends on noise spectrum characteristics of environment where the noise cancellation spot (such as an earphone) is located. For example, in airplanes and cars, there are mainly low-frequency noises below 500 Hz, and the target frequency may be set to be within a range from 50 Hz to 500 Hz. While in places such as bars, there are mainly high-frequency vocals, the target frequency may be set to be within a range from 500 Hz to 2 kHz.

In the embodiment shown in FIGS. 2 and 3, a coefficient of the first filter circuitry is preset. In some embodiments, the coefficient of the first filter circuitry may be updated in real time online. The online real-time updated coefficient mode may be performed based on a residual noise signal which is residual in the noise cancellation spot after the noise cancellation signal is output. The coefficient of the first filter circuitry is updated in real time based on the residual noise signal, so that the generated noise cancellation signal is more approximate to the external noise signal, thereby further improving the noise reduction performance.

Figure 6:
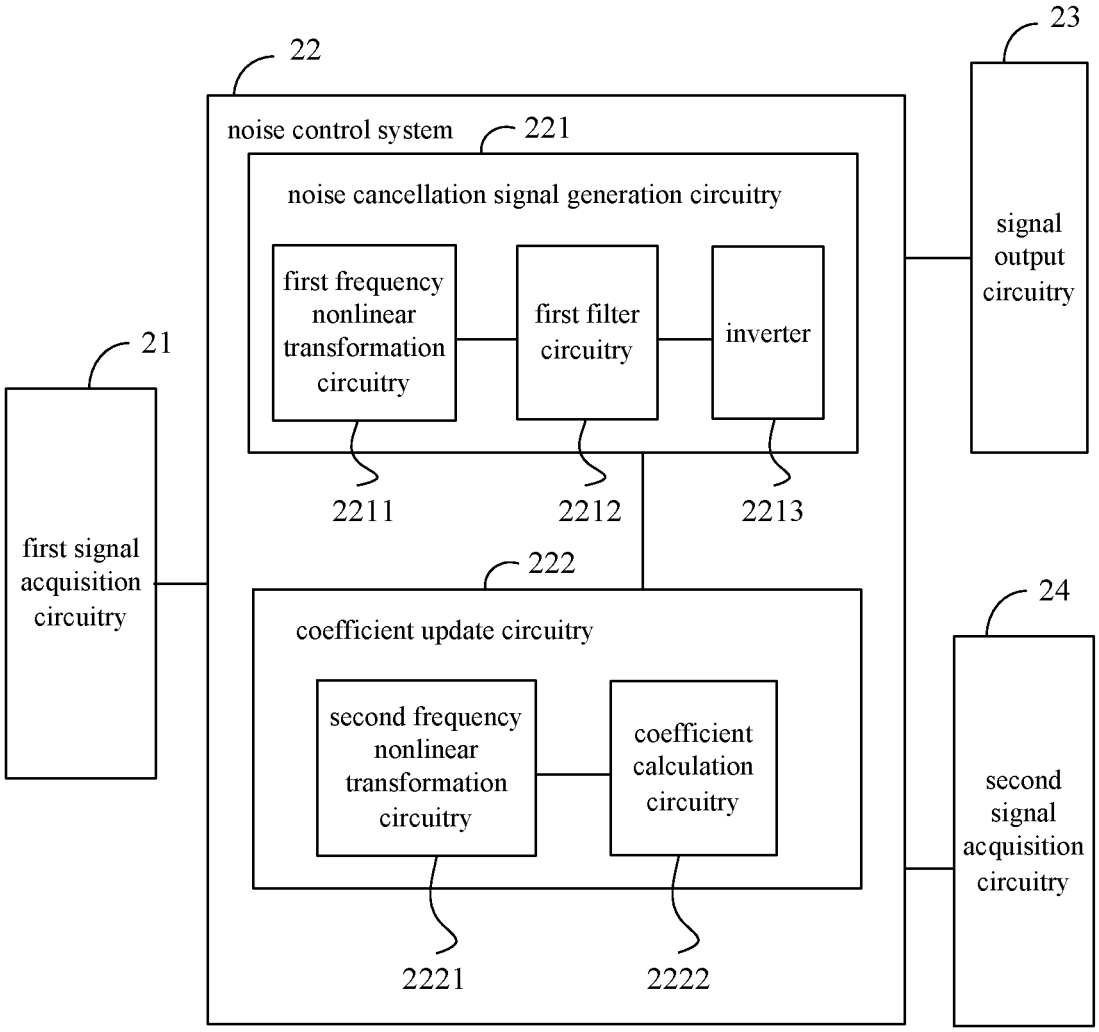
FIG. 6 is a block diagram of an active noise reduction system according to an embodiment.

FIG. 6 is a block diagram of an active noise reduction system according to an embodiment.

Compared with the active noise reduction system shown in FIG. 2, the active noise reduction system shown in FIG. 6 further includes a second signal acquisition circuitry 24, and a noise control system 22 further includes a coefficient update circuitry 222. The second signal acquisition circuitry 24 is configured to acquire a residual noise signal, and transmit the acquired residual noise signal to the coefficient update circuitry 222. The coefficient update circuitry 222 is configured to update a coefficient of a first filter circuitry 2212 based on the residual noise signal in real time.

Similar to a first signal acquisition circuitry 21, the second signal acquisition circuitry 24 also includes a microphone and an analog to digital converter. The microphone converts the acquired residual noise signal into an analog electric signal, and the analog to digital converter converts the analog electric signal into a digital signal.

In some embodiments, the coefficient update circuitry 222 includes a second frequency nonlinear transformation circuitry 2221 and a coefficient calculation circuitry 2222. The second frequency nonlinear transformation circuitry 2221 is configured to expand at least one target frequency band of the external noise signal to generate a second transformed external noise signal. The coefficient calculation circuitry 2222 is configured to calculate a coefficient of the first filter circuitry 2212 based on the residual noise signal and the second transformed external noise signal.

As the first filter circuitry 2212 operates on a frequency nonlinear transformation domain, the coefficient calculation circuitry 2222 providing the update coefficients for the first filter circuitry 2212 also needs to operate on the frequency nonlinear transform domain. Therefore, the coefficient update circuitry 222 includes a second frequency nonlinear transformation circuitry 2221. In some embodiments, processing to the external noise signal by the second frequency nonlinear transformation circuitry 2221 is the same as the processing to the external noise signal by the first frequency nonlinear transformation circuitry 2211.

Figure 7:
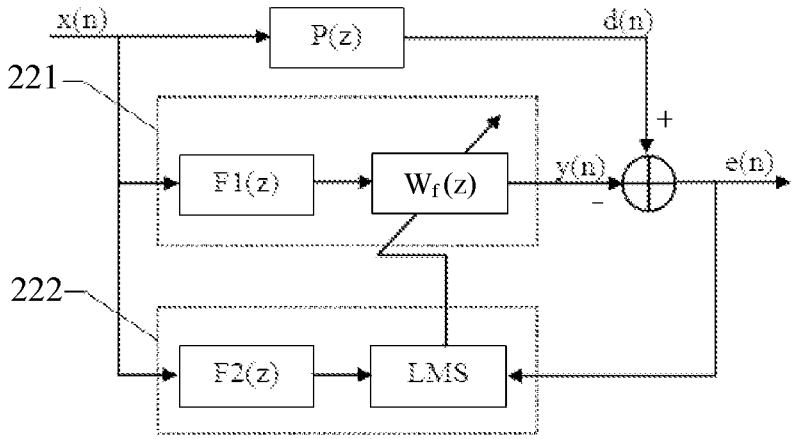
FIG. 7 is a structural diagram of the active noise reduction system as shown in FIG. 6.

FIG. 7 is a structural diagram of the active noise reduction system as shown in FIG. 6. Referring to FIG. 7, e(n) represents the residual noise signal acquired by the second signal acquisition circuitry 24, LMS represents the coefficient calculation circuitry 2222, and F2(z) represents a frequency nonlinear transformation mapping function adopted by the second frequency nonlinear transformation circuitry 2221. Different from FIG. 3, the LMS circuitry also updates the coefficient of $W_f(z)$ based on the residual noise signal e(n) and the second transformed external noise signal in real time, thereby implementing adaptive active noise reduction, so that the noise reduction performance may be better.

In some embodiments, the LMS circuitry implements the real-time update of the coefficient of the first filter circuitry based on Equation (1), $$h(n+1)=h(n)+\mu^{*}s(n)^{*}e(n) \quad (1),$$

where h(n+1) is the coefficient of the first filter circuitry at a current time point, h(n) is the coefficient of the first filter circuitry at a previous time point, μ is an update step size, s(n) is the external noise signal subjected to the processing by F2(z), and e(n) is the residual noise signal.

In some embodiments, the noise cancellation signal generation circuitry 221 further includes a first downsampling rate circuitry and an upsampling rate circuitry (not shown), and the coefficient update circuitry further includes a second downsampling rate circuitry (not shown). The first downsampling rate circuitry is configured to downsample the external noise signal to an operation sampling rate of the first frequency nonlinear transformation circuitry 2211, and the upsampling rate circuitry is configured to upsample the noise cancellation signal to the operation sampling rate of the signal output circuitry 23, and the second downsampling rate circuitry is configured to downsample the external noise signal to the operation sampling rate of the second frequency nonlinear transformation circuitry 2221.

In some embodiments, the first downsampling rate circuitry and the second downsampling rate circuitry are downsampling filters, and the upsampling rate circuitry is an upsampling filter. Each of the first downsampling rate circuitry and the second downsampling rate circuitry includes a high-pass filter and a low-pass filter for removing a direct current and high-frequency interference.

In some embodiments, the operation sampling rate is 384 kHz, 192 kHz or 96 kHz.

The above embodiments have been described by taking the noise control system as a single feedforward system as an example. Alternatively, the noise control system may be a single feedback system or a feedforward plus feedback hybrid system.

Figure 8:
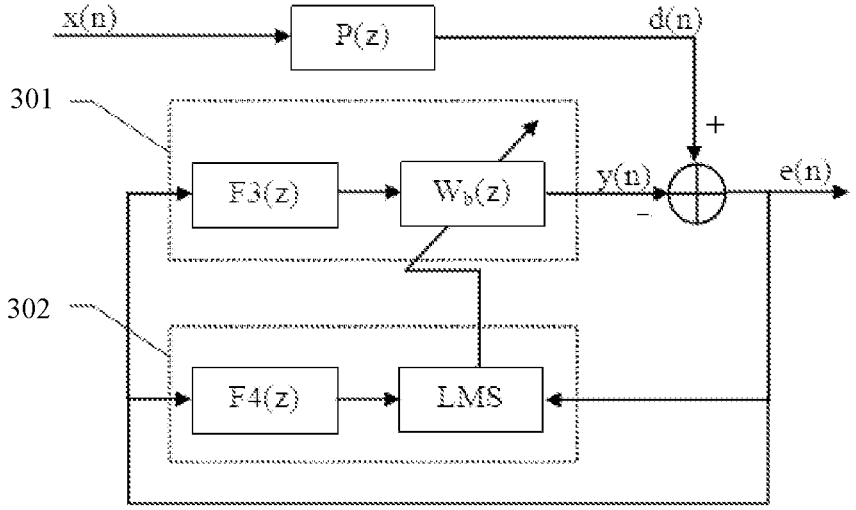
FIG. 8 is a structural diagram of an active noise reduction system according to an embodiment.

FIG. 8 is a structural diagram of an active noise reduction system according to an embodiment. The noise control system in the embodiment is a single feedback system.

Referring to FIG. 8, initially, an external noise signal d(n) after passing through an earphone shell serves as a residual noise signal e(n). e(n) is subjected to processing of a coefficient update circuitry 302 including a frequency nonlinear transformation circuitry F4(z) and a coefficient calculation circuitry LMS to generate a filter coefficient to be used by a filter $W_b(z)$. Besides, e(n) is subjected to processing of a noise cancellation generation circuitry 301 including a frequency nonlinear transformation circuitry F3(z) and the filter $W_b(z)$ to generate a signal y(n) which is then inverted to be a noise cancellation signal. The noise cancellation signal interferes with the external noise signal d(n) to form a new residual noise signal e(n). The above process is performed repeatedly.

Figure 9:
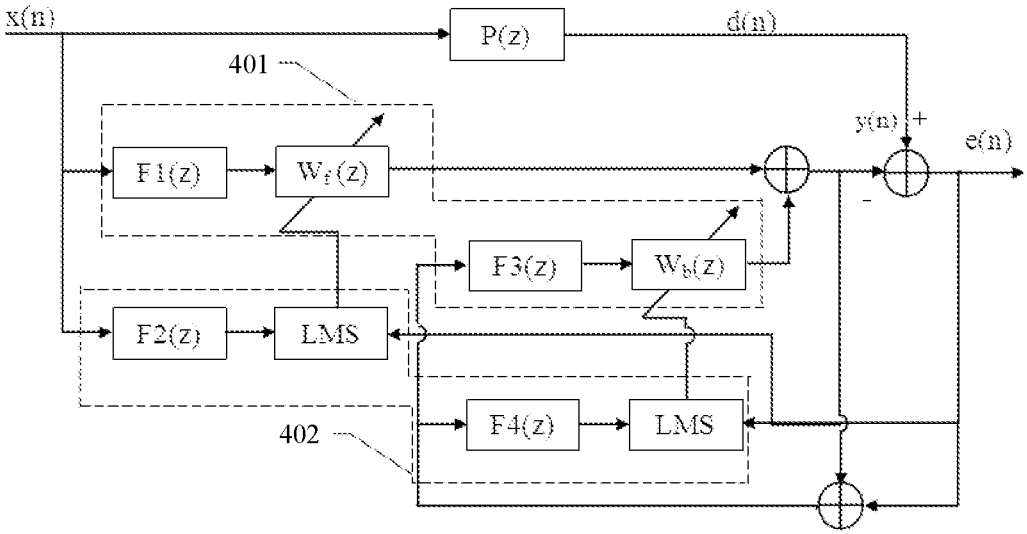
FIG. 9 is a structural diagram of an active noise reduction system according to an embodiment.

FIG. 9 is a structural diagram of an active noise reduction system according to an embodiment. The active noise reduction system includes a noise cancellation generation circuitry 401 and a coefficient update circuitry 402. A noise control system in the active noise reduction system is a feedforward plus feedback hybrid system. It can be understood that the active noise reduction system shown in FIG. 9 is a combination of FIGS. 7 and 8 to achieve better noise reduction performance.

The active noise reduction system shown in FIG. 9 employs a mode in which a coefficient of a filter is updated online in real time, i.e., an online real-time updated coefficient mode. If the active noise reduction system adopts a mode where a coefficient of a filter is preset, the coefficient update circuitry 402 is not included. Compared with FIG. 2, the active noise reduction system in the embodiment further includes a second signal acquisition circuitry, and the noise control system further includes a third frequency nonlinear transformation circuitry, a second filter circuitry and a mixing circuitry.

The second signal acquisition circuitry is configured to acquire a residual noise signal, the third frequency nonlinear transformation circuitry is configured to receive the residual noise signal, and expand at least one target frequency band of the residual noise signal to generate a transformed residual noise signal. the second filter circuitry is configured to filter the transformed residual noise signal to generate a filtered residual noise signal, the mixing circuitry is configured to combine the filtered external noise signal with the filtered residual noise signal to generate a combined noise signal; and the inverter is configured to perform inversion on the combined noise signal to form the noise cancellation signal.

Figure 10:
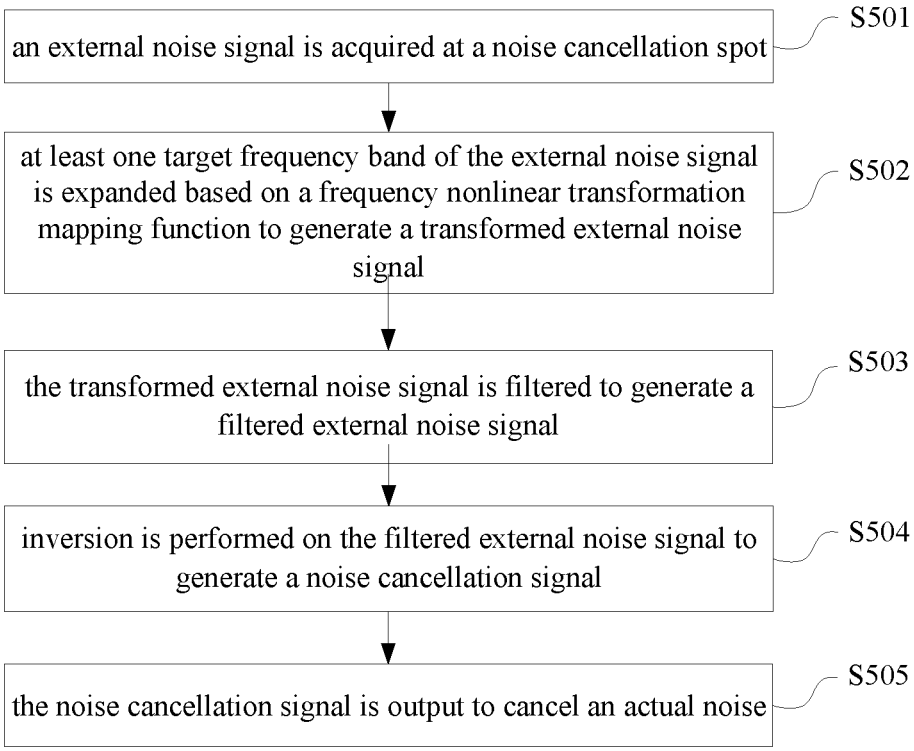
FIG. 10 is a flow chart of an active noise reduction method according to an embodiment.

In an embodiment of the present disclosure, an active noise reduction method is provided. Referring to FIG. 10, the method includes S501 to S505.

In S501, an external noise signal is acquired at a noise cancellation spot.

In S502, at least one target frequency band of the external noise signal is expanded based on a frequency nonlinear transformation mapping function to generate a transformed external noise signal.

In S503, the transformed external noise signal is filtered to generate a filtered external noise signal.

In S504, inversion is performed on the filtered external noise signal to generate a noise cancellation signal.

In S505, the noise cancellation signal is output to cancel an actual noise.

In some embodiments, the noise cancellation spot may be an earphone, a factory, a car, a train or an airplane.

Frequencies of the external noise signal are linear and uniform, while energy at frequencies is generally not uniform. To improve noise reduction performance, it is desired to increase a weight of noise reduction for a frequency band that has a large impact on hearing. Therefore, in the embodiments of the present disclosure, the frequency nonlinear transformation mapping function is provided, where uniform and linear frequencies are mapped to nonlinear frequencies.

In some embodiments, the at least one target frequency band includes a plurality of target frequency bands corresponding to different expansion ratios.

In some embodiments, prior to the filtering, the method further includes: compressing at least one other frequency band other than the at least one target frequency band of the external noise signal. In some embodiments, besides expanding the at least one target frequency band, acoustically unimportant frequency bands may be compressed, so that the noise reduction further leans to the target frequency band. A purpose of the frequency nonlinear transformation mapping function is to expand the at least one target frequency band and compress at least one other frequency band. The target frequency band is an acoustically important frequency band which has a relatively large influence on hearing, and the other frequency band is an acoustically unimportant frequency band. In some embodiments, the target frequency band has higher noise energy.

In some embodiments, the at least one other frequency band includes a plurality of frequency bands corresponding to different compression ratios.

In some embodiments, the frequency nonlinear transformation mapping function may be implemented with, but not limited to, an all-pass filter, which ensures that a signal subjected to the frequency nonlinear transformation remains its amplitude constant and has its phase nonlinearly changed, thereby achieving nonlinear transformation of the frequency.

In some embodiments, the method further includes: acquiring a residual noise signal; and updating a coefficient of a filter circuitry which filters the transformed external noise signal based on the residual noise signal in real time.

In some embodiments, the coefficient of the filter circuitry is calculated based on the residual noise signal and the transformed external noise signal.

In some embodiments, the method employs a feedforward plus feedback hybrid mode, and further includes: acquiring a residual noise signal; expanding at least one target frequency band of the residual noise signal to generate a transformed residual noise signal; filtering the transformed residual noise signal to generate a filtered residual noise signal; combining the filtered external noise signal with the filtered residual noise signal to generate a combined noise signal; and performing inversion on the combined noise signal to generate the noise cancellation signal.

More details about the active noise reduction may be referred to the descriptions of the above embodiments, and are not described in detail here.

In an embodiment of the present disclosure, a storage medium having computer instructions stored therein is provided, wherein once the computer instructions are executed, the above active noise reduction method is performed. The storage medium may include a Read Only Memory (ROM), a Random Access Memory (RAM), a magnetic disk, an optical disk or the like. Alternatively, the storage medium may include a non-volatile or non-transitory memory or the like.

Although the present disclosure has been disclosed above with reference to preferred embodiments thereof, it should be understood that the disclosure is presented by way of example only, and not limitation. Those skilled in the art can modify and vary the embodiments without departing from the spirit and scope of the present disclosure.

What is claimed is:

1. An active noise reduction system, comprising a first signal acquisition circuitry, a noise control system and a signal output circuitry, wherein the first signal acquisition circuitry and the signal output circuitry are coupled with the noise control system, wherein the first signal acquisition circuitry is configured to acquire an external noise signal at a noise cancellation spot, and transmit the acquired external noise signal to the noise control system;

the noise control system comprises a noise cancellation signal generation circuitry, the noise cancellation signal generation circuitry comprises a first frequency nonlinear transformation circuitry, a first filter circuitry and an inverter, wherein the first frequency nonlinear transformation circuitry is configured to receive the external noise signal, and expand at least one target frequency band of the external noise signal based on a frequency nonlinear transformation mapping function to generate a first transformed external noise signal, the first filter circuitry is configured to filter the first transformed external noise signal to generate a filtered external noise signal, and the inverter is configured to perform inversion on the filtered external noise signal to generate a noise cancellation signal; and the signal output circuitry is configured to receive and output the noise cancellation signal to cancel an actual noise, wherein the active noise reduction system further comprises a second signal acquisition circuitry, and the noise control system further comprises a coefficient update circuitry, wherein the second signal acquisition circuitry is configured to acquire a residual noise signal and transmit the acquired residual noise signal to the coefficient update circuitry, and the coefficient update circuitry is configured to update a coefficient of the first filter circuitry based on the residual noise signal in real time.

2. The active noise reduction system according to claim 1, wherein the at least one target frequency band comprises a plurality of target frequency bands corresponding to different expansion ratios.

3. The active noise reduction system according to claim 1, wherein the first frequency nonlinear transformation circuitry is further configured to compress at least one other frequency band other than the at least one target frequency band of the external noise signal.

4. The active noise reduction system according to claim 3, wherein the at least one other frequency band comprises a plurality of frequency bands corresponding to different compression ratios.

5. The active noise reduction system according to claim 1, wherein the coefficient update circuitry comprises a second frequency nonlinear transformation circuitry and a coefficient calculation circuitry, wherein the second frequency nonlinear transformation circuitry is configured to expand the at least one target frequency band of the external noise signal to generate a second transformed external noise signal, and the coefficient calculation circuitry is configured to calculate the coefficient of the first filter circuitry based on the residual noise signal and the second transformed external noise signal.

6. The active noise reduction system according to claim 5, wherein the noise cancellation signal generation circuitry further comprises a first downsampling rate circuitry and an upsampling rate circuitry, and the coefficient update circuitry comprises a second downsampling rate circuitry, wherein the first downsampling rate circuitry is configured to downsample the external noise signal to an operation sampling rate of the first frequency nonlinear transformation circuitry, the upsampling rate circuitry is configured to upsample the noise cancellation signal to an operation sampling rate of the signal output circuitry, and the second downsampling rate circuitry is configured to downsample the external noise signal to an operation sampling rate of the second frequency nonlinear transformation circuitry.

7. An active noise reduction system, comprising a first signal acquisition circuitry, a noise control system and a signal output circuitry, wherein the first signal acquisition circuitry and the signal output circuitry are coupled with the noise control system, wherein the first signal acquisition circuitry is configured to acquire an external noise signal at a noise cancellation spot, and transmit the acquired external noise signal to the noise control system;

the noise control system comprises a noise cancellation signal generation circuitry, the noise cancellation signal generation circuitry comprises a first frequency nonlinear transformation circuitry, a first filter circuitry and an inverter, wherein the first frequency nonlinear transformation circuitry is configured to receive the external noise signal, and expand at least one target frequency band of the external noise signal based on a frequency nonlinear transformation mapping function to generate a first transformed external noise signal, the first filter circuitry is configured to filter the first transformed external noise signal to generate a filtered external noise signal, and the inverter is configured to perform inversion on the filtered external noise signal to generate a noise cancellation signal; and the signal output circuitry is configured to receive and output the noise cancellation signal to cancel an actual noise, wherein the noise control system is a feedforward plus feedback hybrid system, the active noise reduction system further comprises a second signal acquisition circuitry, and the noise control system further comprises a third frequency nonlinear transformation circuitry, a second filter circuitry and a mixing circuitry, wherein the second signal acquisition circuitry is configured to acquire a residual noise signal, the third frequency nonlinear transformation circuitry is configured to receive the residual noise signal and expand at least one target frequency band of the residual noise signal to generate a transformed residual noise signal, the second filter circuitry is configured to filter the transformed residual noise signal to generate a filtered residual noise signal, and the mixing circuitry is configured to combine the filtered external noise signal with the filtered residual noise signal to generate a combined noise signal, and the inverter is configured to perform inversion on the combined noise signal to generate the noise cancellation signal.

8. The active noise reduction system according to claim 7, wherein the at least one target frequency band comprises a plurality of target frequency bands corresponding to different expansion ratios.

9. The active noise reduction system according to claim 7, wherein the first frequency nonlinear transformation circuitry is further configured to compress at least one other frequency band other than the at least one target frequency band of the external noise signal.

10. The active noise reduction system according to claim 9, wherein the at least one other frequency band comprises a plurality of frequency bands corresponding to different compression ratios.

11. An active noise reduction method, comprising:

acquiring an external noise signal at a noise cancellation spot;

expanding at least one target frequency band of the external noise signal based on a frequency nonlinear transformation mapping function to generate a transformed external noise signal;

filtering the transformed external noise signal to generate a filtered external noise signal;

performing inversion on the filtered external noise signal to generate a noise cancellation signal; and outputting the noise cancellation signal to cancel an actual noise, wherein the method, further comprises:

acquiring a residual noise signal; and updating a coefficient of a filter circuitry which filters the transformed external noise signal based on the residual noise signal in real time.

12. The method according to claim 11, wherein the at least one target frequency band comprises a plurality of target frequency bands corresponding to different expansion ratios.

13. The method according to claim 11, wherein prior to the filtering, the method further comprises:

compressing at least one other frequency band other than the at least one target frequency band of the external noise signal.

14. The method according to claim 13, wherein the at least one other frequency band comprises a plurality of frequency bands corresponding to different compression ratios.

15. The method according to claim 11, wherein the coefficient of the filter circuitry is calculated based on the residual noise signal and the transformed external noise signal.

16. A non-transitory storage medium having computer instructions stored therein, wherein once the computer instructions are executed, the method according to claim 11 is performed.

17. An active noise reduction method, comprising:

acquiring an external noise signal at a noise cancellation spot;

expanding at least one target frequency band of the external noise signal based on a frequency nonlinear transformation mapping function to generate a transformed external noise signal;

filtering the transformed external noise signal to generate a filtered external noise signal;

performing inversion on the filtered external noise signal to generate a noise cancellation signal; and outputting the noise cancellation signal to cancel an actual noise, wherein the method employs a feedforward plus feedback hybrid mode, and further comprises:

acquiring a residual noise signal;

expanding at least one target frequency band of the residual noise signal to generate a transformed residual noise signal;

filtering the transformed residual noise signal to generate a filtered residual noise signal;

combining the filtered external noise signal with the filtered residual noise signal to generate a combined noise signal; and performing inversion on the combined noise signal to generate the noise cancellation signal.

18. The method according to claim 17, wherein the at least one target frequency band comprises a plurality of target frequency bands corresponding to different expansion ratios.

19. The method according to claim 17, wherein prior to the filtering, the method further comprises:

compressing at least one other frequency band other than the at least one target frequency band of the external noise signal.

20. The method according to claim 19, wherein the at least one other frequency band comprises a plurality of frequency bands corresponding to different compression ratios.

21. A non-transitory storage medium having computer instructions stored therein, wherein once the computer instructions are executed, the method according to claim 17 is performed.

* * * * *